US009518573B2

(12) United States Patent
Kim

(10) Patent No.: US 9,518,573 B2
(45) Date of Patent: Dec. 13, 2016

(54) RECIPROCATING COMPRESSOR WITH GAS BEARING

(75) Inventor: Donghan Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 373 days.

(21) Appl. No.: 13/602,744

(22) Filed: Sep. 4, 2012

(65) Prior Publication Data

US 2013/0058815 A1 Mar. 7, 2013

(30) Foreign Application Priority Data

Sep. 6, 2011 (KR) ..... 10-2011-0090324

(51) Int. Cl.

| | |
|---|---|
| ***F04B 53/10*** | (2006.01) |
| ***F04B 35/04*** | (2006.01) |
| ***F04B 39/02*** | (2006.01) |
| ***F04B 39/00*** | (2006.01) |
| ***F04B 39/12*** | (2006.01) |

(52) U.S. Cl.

CPC ..... *F04B 35/045* (2013.01); *F04B 39/0005* (2013.01); *F04B 39/0027* (2013.01); *F04B 39/02* (2013.01); *F04B 39/023* (2013.01); *F04B 39/0215* (2013.01); *F04B 39/0223* (2013.01); *F04B 39/0276* (2013.01); *F04B 39/0292* (2013.01); *F04B 39/122* (2013.01); *F04B 39/123* (2013.01)

(58) Field of Classification Search

CPC ..... F04B 35/045; F04B 39/122; F04B 39/02; F04B 39/0027; F04B 39/0005; F04B 39/123; F04B 39/023; F04B 39/0292; F04B 39/0215

USPC ..... 417/417; 92/174; 384/109

See application file for complete search history.

(56) References Cited

U.S. PATENT DOCUMENTS

| | | | | |
|---|---|---|---|---|
| 6,293,184 | B1 * | 9/2001 | Unger | F02G 1/0435 384/12 |
| 6,379,125 | B1 | 4/2002 | Tojo et al. | |
| 7,614,856 | B2 * | 11/2009 | Inagaki et al. | 417/417 |
| 2004/0025502 | A1 * | 2/2004 | Okano et al. | 60/517 |
| 2006/0250032 | A1 | 11/2006 | Her | |
| 2009/0220365 | A1 | 9/2009 | Kang et al. | 417/570 |
| 2010/0021323 | A1 | 1/2010 | Schubert | |

(Continued)

FOREIGN PATENT DOCUMENTS

| | | |
|---|---|---|
| CN | 1579044 A | 2/2005 |
| CN | 101835982 A | 9/2010 |

(Continued)

OTHER PUBLICATIONS

Korean Office Action dated Nov. 29, 2012.

(Continued)

*Primary Examiner* — William H Rodriguez
*Assistant Examiner* — Stephen Mick
(74) *Attorney, Agent, or Firm* — Ked & Associates LLP

(57) ABSTRACT

A reciprocating compressor with a gas bearing is configured to support a portion between a cylinder and a piston by the gas bearing and induce a resonating motion of the piston by the use of compression coil springs. Therefore, a proper resonating motion of a vibrating body can be induced by the use of the gas bearing, without using plate springs, and accordingly manufacturing costs and the number of assembly processes can be reduced and the installation direction of the compressor can be freely designed.

7 Claims, 10 Drawing Sheets

(56) References Cited

U.S. PATENT DOCUMENTS

| | | | | |
|---|---|---|---|---|
| 2010/0098356 | A1* | 4/2010 | Giacchi et al. | 384/12 |
| 2010/0310763 | A1* | 12/2010 | Oboodi et al. | 427/191 |
| 2010/0316513 | A1* | 12/2010 | Lee et al. | 417/417 |
| 2011/0135518 | A1* | 6/2011 | Kang et al. | 417/417 |

FOREIGN PATENT DOCUMENTS

| | | | |
|---|---|---|---|
| CN | 102105690 | A | 6/2011 |
| EP | 1 450 472 | | 8/2004 |
| JP | 2004-332651 | | 11/2004 |
| KR | 10-2001-0018431 | | 3/2001 |
| KR | 10-2005-0017235 | | 2/2005 |
| KR | 10-2006-0115808 | | 11/2006 |

OTHER PUBLICATIONS

Korean Office Action dated Jul. 29, 2013.
Chinese Office Action with English Translation issued in Application No. 201210327761.9 dated Oct. 8, 2014.
European Search Report dated Jun. 1, 2015.

* cited by examiner

RECIPROCATING COMPRESSOR WITH GAS BEARING

CROSS-REFERENCE TO RELATED APPLICATION

The present disclosure relates to subject matter contained in priority Korean Application No. 10-2011-0090324, filed on Sep. 6, 2011, which is herein expressly incorporated by reference in its entirety.

BACKGROUND OF THE INVENTION

1. Field of the Invention

The present disclosure relates to a reciprocating compressor, and more particularly, to a reciprocating compressor with a gas bearing.

2. Background of the Invention

Generally, a reciprocating compressor serves to intake, compress, and discharge a refrigerant as a piston linearly reciprocates within a cylinder. The reciprocating compressor may be classified into a connection type reciprocating compressor or a vibration type reciprocating compressor according to the method employed to drive the piston.

In the connection type reciprocating compressor, the piston is connected to a rotating shaft associated with a rotation motor by a connection rod, which causes the piston to reciprocate within the cylinder, thereby compressing the refrigerant. On the other hand, in the vibration type reciprocating compressor, the piston is connected to a mover associated with a reciprocating motor, which vibrates the piston while the piston reciprocates within the cylinder, thereby compressing the refrigerant. The present invention relates to the vibration type reciprocating compressor, and the term "reciprocating compressor" will hereinafter refer to the vibration type reciprocating compressor.

To enhance the performance of a reciprocating compressor, a portion between the cylinder and the piston, being hermetically sealed, has to be properly lubricated. To this end, there has been conventionally known a reciprocating compressor which seals and lubricates a portion between the cylinder and the piston by supplying a lubricant such as oil between the cylinder and the piston and forming an oil film.

However, the supplying of the lubricant requires an oil supply apparatus, and an oil shortage may occur depending on operation conditions, thereby degrading compressor performance. Also, the compressor size needs to be increased because a space for receiving a certain amount of oil is required, and the installation direction of the compressor is limited because the entrance of the oil supply apparatus should always be kept immersed in oil.

Taking into consideration the disadvantages of the oil-lubricated type reciprocating compressor, as shown in FIG. 1, there has been conventionally known a technique of forming a gas bearing between the piston 1 and the cylinder 2 by bypassing a part of compressed gas between the piston 1 and the cylinder 2. In this technique, a plurality of gas flow paths 2*a* with a small diameter are formed in the cylinder 2, or a sintered porous material member (not shown) is provided on an inner circumferential surface of the cylinder 2. This technique can simplify a lubrication structure of the compressor because it requires no oil supply apparatus, unlike the oil-lubricated type for supplying oil between the piston 1 and the cylinder 2, and can maintain constant compressor performance by preventing an oil shortage depending on operating conditions. Also, this technique has the advantage that the compressor can be smaller in size and the installation direction of the compressor can be freely designed because no space for receiving oil is required in the casing of the compressor.

In the case the gas bearing is applied to the reciprocating compressor, a plate spring 3 is used for a resonating motion of the piston, as shown FIG. 2.

In the case the plate spring 3 is used, the piston (shown in FIG. 1) 1 constituting a compression portion 4 and the plate spring (shown in FIG. 2) 3 are connected by a flexible connecting bar (not shown) so that the piston 1 has forward movability within the cylinder (shown in FIG. 1) 2, or the connecting bar is divided into a plurality of parts 5*a* to 5*c* and connected by at least one (preferably two or more) links 6*a* and 6*b*. In the drawings, unexplained reference numeral 7 denotes a reciprocating motor.

In the case that the reciprocating compressor with a gas bearing uses the plate spring for a resonating motion as described above, the aforementioned flexible connecting bar has to be used to connect between members, or a plurality of connecting bars have to be connected by links, which may increase material costs and the number of assembly processes.

Moreover, displacement in the movement direction of the piston (hereinafter, 'longitudinal displacement') occurs a lot because of the characteristics of the plate spring, whereas displacement in a direction orthogonal to the motion direction of the piston (hereinafter, lateral displacement) rarely occurs. Thus, if the piston is arranged to move in a vertical direction, the piston may hang vertically downward when stopped, thus distorting the initial position of the piston. Taking this into account, the piston needs to be arranged so as to move in a horizontal direction, which is a limitation to the installation of a compression portion and a driving portion.

SUMMARY OF THE INVENTION

Therefore, an object of the present invention is to provide a reciprocating compressor with a gas bearing which induces a proper resonating motion of a vibrating body by using the gas bearing, without the use of a plate spring, and therefore decreases material costs and the number of assembly processes and freely design the installation direction of the compressor.

To achieve these and other advantages and in accordance with the purpose of this specification, as embodied and broadly described herein, there is provided a reciprocating compressor with a gas bearing, the reciprocating compressor comprising: a cylinder having a compression space; a piston inserted into the compression space and reciprocating relative to the cylinder; a gas bearing for lubricating a bearing surface of the cylinder and the piston by gas; and resonant springs supporting both sides of a reciprocating member, which is either the cylinder or the piston, in the motion direction, wherein the resonant springs comprise a first resonant spring and a second resonant spring that are formed as compression coil springs and respectively provided on both sides of the reciprocating member, at least either the first resonant spring or the second resonant spring being provided in plural.

Furthermore, there is provided a reciprocating compressor with a gas bearing, the reciprocating compressor comprising: a cylinder having a compression space; a piston inserted into the compression space and reciprocating relative to the cylinder; a gas bearing for lubricating a bearing surface of the cylinder and the piston by gas; and resonant springs supporting both sides of a reciprocating member, which is either the cylinder or the piston, in the motion direction, wherein the resonant springs comprise a first resonant spring and a second resonant spring that are formed as compression coil springs and respectively provided on both sides of the reciprocating member, at least either the first resonant spring or the second resonant spring being provided in plural, the plurality of resonant springs being arranged such that lines orthogonal to the front end surfaces of at least two resonant springs in the winding direction meet at one point.

BRIEF DESCRIPTION OF THE DRAWINGS

The accompanying drawings, which are included to provide a further understanding of the invention and are incorporated in and constitute a part of this specification, illustrate exemplary embodiments and together with the description serve to explain the principles of the invention.

In the drawings.

DETAILED DESCRIPTION OF THE INVENTION

Hereinafter, a reciprocating compressor with a gas bearing according to the present invention will be described in detail with reference to an embodiment illustrated in the accompanying drawings.

Figure 1:
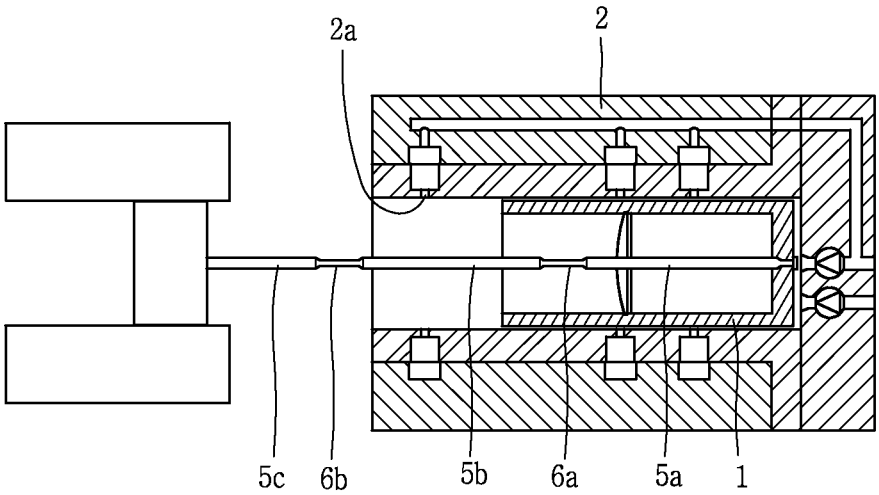
FIG. 1 CONVENTIONAL ART
FIG. 1 is a longitudinal cross-sectional view showing an example in which a conventional gas bearing is applied to a reciprocating compressor.
Figure 2:
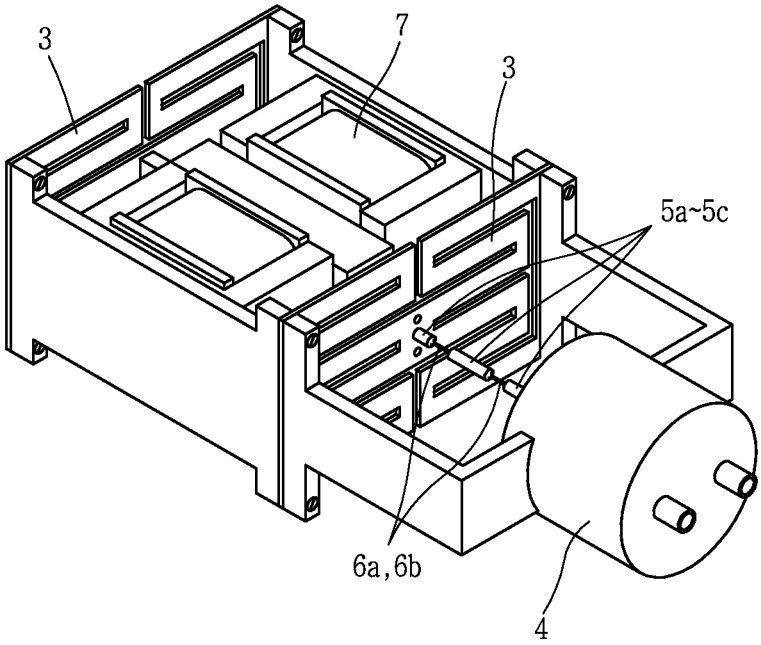
FIG. 2 CONVENTIONAL ART
FIG. 2 is a perspective view showing an example in which conventional plate springs are applied to a reciprocating compressor.
Figure 3:
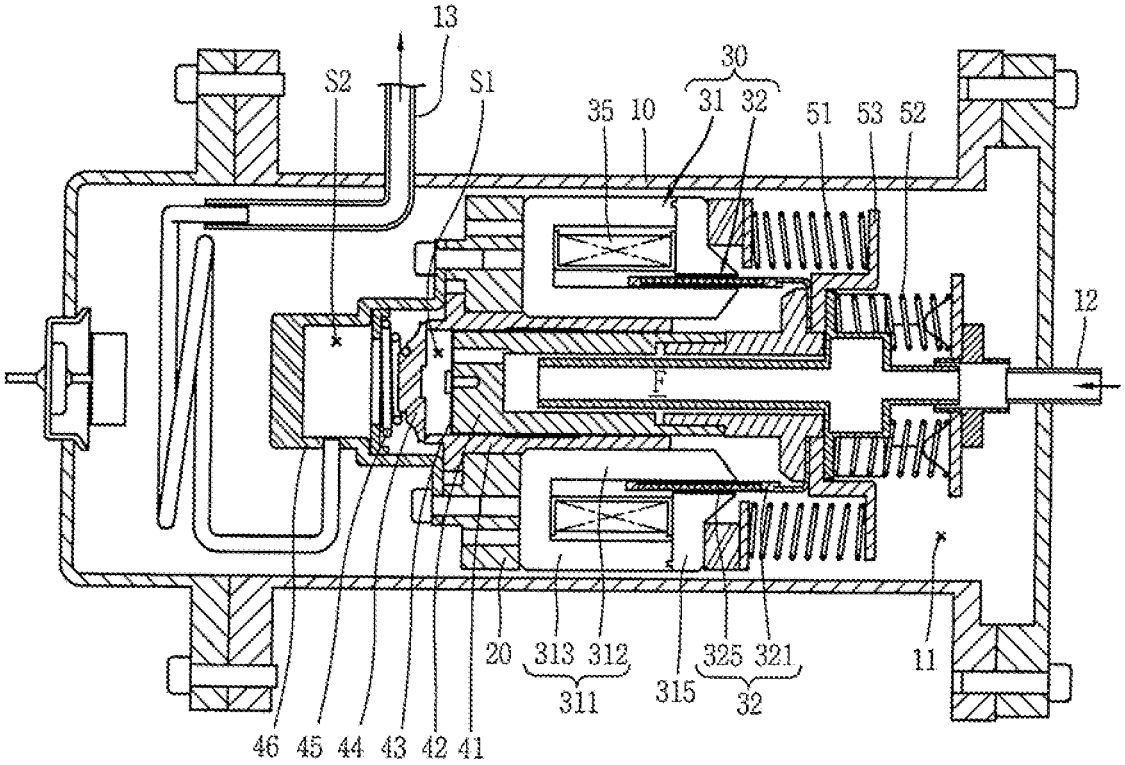
FIG. 3 is a longitudinal cross-sectional view showing a reciprocating compressor according to the present invention.

As shown in FIG. 3, in the reciprocating compressor according to this embodiment, a frame 20 is installed within a sealed casing 10, a reciprocating motor 30 and a cylinder 41 are fixed to the frame 20, a piston 42 coupled to a mover 32 of the reciprocating motor 30 is inserted into the cylinder 41 to reciprocate, and resonant springs 51 and 52 for inducing a resonating motion of the piston 42 are installed at both sides of the piston 42 in the motion direction of the piston 42.

In the aforementioned reciprocating compressor according this embodiment, when power is applied to a coil 35 of the reciprocating motor 30, the mover 32 of the reciprocating motor 30 reciprocates. Then, the piston 42 coupled to the mover 32 sucks and compresses a refrigerant gas while linearly reciprocating within the cylinder 41, and discharges it.

More specifically, when the piston 42 moves backwards, the refrigerant gas in the sealed casing 10 is sucked into the compression space S1 through the suction path F of the piston 42, and when the piston 42 moves forwards, the suction path F is closed and the refrigerant gas in the compression space S1 is compressed. Also, when the piston 42 further moves forwards, the discharge valve 44 is opened to discharge the refrigerant gas compressed in the compression space S1 and move it to the outside refrigeration cycle.

Figure 4:
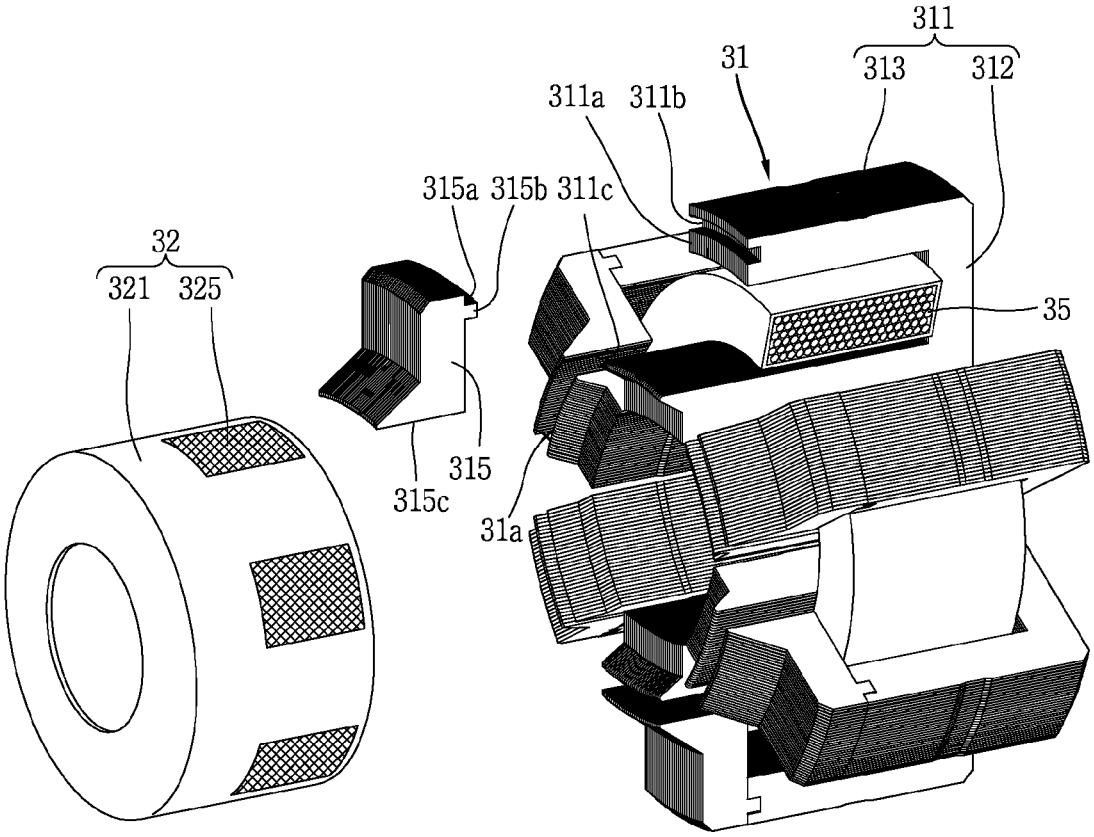
FIG. 4 is an exploded perspective view showing a reciprocating motor in the reciprocating compressor of FIG. 3.
Figure 5:
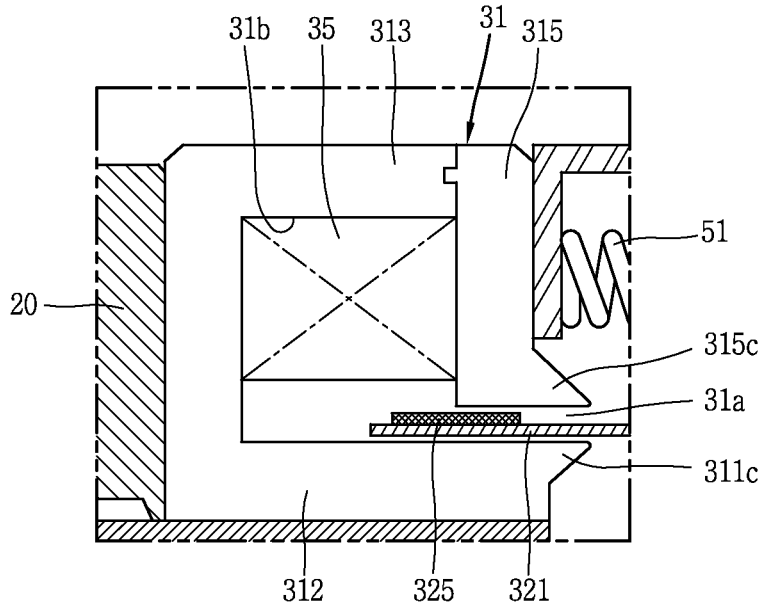
FIG. 5 is a half cross-sectional view showing an example of a stator in a reciprocating motor of FIG. 3.

As shown in FIGS. 4 and 5, the reciprocating motor 30 comprises a stator 31 having a coil 35 and an air gap formed at only one side of the coil 35 and a mover 32 inserted into the air gap of the stator 31 and having a magnet 325 that linearly moves in the motion direction.

The stator 31 includes a plurality of stator blocks 311 and a plurality of pole blocks 315 respectively coupled to sides of the stator blocks 311 and forming an air gap portion 31*a* along with the stator blocks 311.

The stator blocks 311 and the pole blocks 315 include a plurality of thin stator cores laminated sheet by sheet in a circular arc shape when axially projected.

The stator blocks 311 are formed in the shape of recesses when axially projected, and the pole blocks 315 are formed in a rectangular shape when axially projected.

The stator block (or each of the stator core sheets constituting the stator blocks) 311 may include a first magnetic path 312 positioned inside the mover 32 to form the inner stator and a second magnetic path 313 extending integrally from an axial side of the first magnetic path 312, i.e., the opposite end of the air portion 31*a*, and positioned outside the mover 32 to form the outer stator.

While the first magnetic path 312 is formed in a rectangular shape, the second magnetic path 313 is formed in a stepwise manner and extends from the first magnetic path 312.

A coil receiving slot 31*b* opened in an axial direction, i.e., the direction of the air gap portion, is formed on inner wall surfaces of the first and second magnetic paths 312 and 313, and the pole block 315 is coupled to an axial cross-section of the second magnetic path 313 which constitutes the coil receiving slot 31*b* so as to open an axial open surface of the coil receiving slot 31*b*.

Also, a coupling groove 311*b* and a coupling protrusion 315*b* may be formed on a coupling surface of the stator block 311 and a coupling surface of the pole block 315, which connect the stator block 311 and the pole block 315 to form a magnetic path connecting portion (not shown), to firmly couple the stator block 311 and the pole block 315 and maintain a given curvature. Although not shown, the stator block 311 and the pole block 315 may be coupled in a stepwise manner.

The coupling surface 311*a* of the stator block 311 and the coupling surface 315*a* of the pole block 315, except the coupling groove 311*b* and the coupling protrusion 315*b*, are formed to be flat, thereby preventing an air gap between the stator block 311 and the pole block 315. This prevents magnetic leakage between the stator block 311 and the pole block 315, thereby leading to an increase in motor performance.

A first pole portion 311*c* having an increasing cross-sectional area is formed at a distal end of the second magnetic path 313 of the stator block 311, i.e., a distal end of the air gap portion 31*a*, and a second pole portion 315*c* having an increasing cross-sectional area is formed at a distal end of the pole block 315, corresponding to the first pole portion 311*c* of the stator block 311.

The mover 32 may include a magnet holder 321 having a cylindrical shape and a plurality of magnets 325 attached onto an outer circumferential surface of the magnet holder 321 in a circumferential direction to form a magnetic flux together with the coil 35.

The magnetic holder 321 may be formed of a non-magnetic substance in order to prevent flux leakage; however, it is not limited thereto. The outer circumferential surface of the magnetic holder 321 may be formed in a circular shape so that the magnets 325 are in line contact therewith and adhered thereto. Also, a magnet mounting groove (not shown) may be formed in a strip shape on the outer circumferential surface of the magnet holder 321 so as to insert the magnets 325 therein and support them in the motion direction.

The magnets 325 may be formed in a hexahedral shape and adhered one by one to the outer circumferential surface of the magnet holder 321. In the case of attaching the magnets 325 one by one, supporting members (not shown), such as fixing rings or a tape made up of a composite material.

Although the magnets 325 may be serially adhered in a circumferential direction to the outer circumferential surface of the magnet holder 321, it is preferable that the magnets 325 are adhered at predetermined intervals, i.e., between the stator blocks in a circumferential direction to the outer circumferential surface of the magnet holder 321 to minimize the use of the magnets, because the stator 31 comprises a plurality of stator blocks 311 and the plurality of stator blocks 311 are arranged at predetermined intervals in the circumferential direction. In this case, the magnets 325 are preferably formed to have a length corresponding to the air gap length of the magnetic holder 321, i.e., the circumferential length of the air gap.

Preferably, the magnet 325 may be configured such that its length in a motion direction is not shorter than a length of the air gap portion 31*a* in the motion direction, more particularly, longer than the length of the air gap portion 31*a* in the motion direction. At its initial position or during its operation, the magnet 325 may be disposed such that at least one end thereof is located inside the air gap portion 31*a*, in order to ensure a stable reciprocating motion.

Moreover, though only one magnet 325 may be disposed in the motion direction, a plurality of magnets 325 may be disposed in the motion direction in some cases. In addition, the magnets may be disposed in the motion direction so that an N pole and an S pole correspond to each other.

Figure 6:
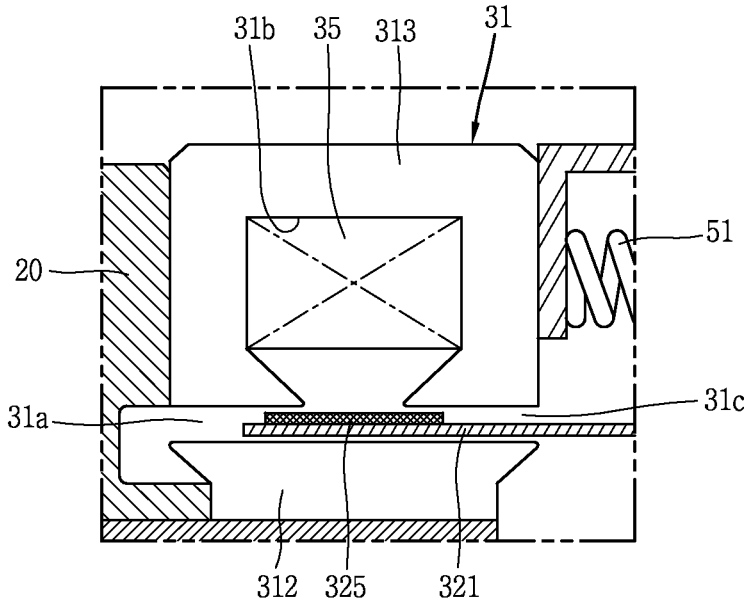
FIG. 6 is a half cross-sectional view showing another embodiment of the stator in the reciprocating motor of FIG. 3.

Although the above-described reciprocating motor may be configured such that the stator has one air gap portion 314 as shown in FIG. 5, it may be configured such that in some cases the stator has air gap portions 31*a* and 31*c* on both sides of the coil in the reciprocating direction as shown in FIG. 6. In this case, too, the mover 32 may be formed in the same manner as the foregoing embodiment.

In the above-stated reciprocating compressor, it is required to reduce a frictional loss between the cylinder and the piston to improve the performance of the compressor. To this end, there has been conventionally known a gas bearing which lubricates between the cylinder and the piston by gas force by bypassing a part of compressed gas between an inner circumferential surface of the cylinder and an outer circumferential surface of the piston. In this case, gas flow paths with a small diameter may be formed in the cylinder, or a sintered porous material member may be provided on the inner circumferential surface of the cylinder.

In the case of forming the gas flow paths as fine pores, however, it is difficult to form the gas flow paths as fine pores, and impurities such as iron powder produced during the operation of the compressor may block the fine gas flow paths. Then, some of the gas flow paths are blocked and a gas force cannot be uniformly applied in a circumferential direction of the piston, and hence a partial friction may occur between the cylinder and the piston. Due to this, the performance and the reliability of the compressor may be degraded, thus requiring very high cleanness.

On the other hand, in the case that a sintered porous material member is inserted into the inner circumferential surface of the cylinder, the porous material member may be abraded upon initial startup before the formation of the gas bearing because of high manufacturing cost of the porous material member and low abrasion resistance thereof, and therefore the lifespan of the porous material member may be degraded. Also, it is difficult to properly regulate the distribution of pores because of the characteristics of the porous material member, which can make it difficult to design the gas bearing so as to properly seal and lubricate a portion between the cylinder and the piston.

Moreover, in the case that the exits of the gas flow paths are formed in the cylinder, suction loss occurs as the outlets of the gas flow paths are exposed to the compression space during a suction stroke to thus cause a high-pressure refrigerant to enter the compression space. On the other hand, in the case that the inlets of the gas flow paths are formed in the piston, gas from the gas bearing flows backward to the compression space as the inlets of the gas flow paths are exposed to the compression space during a suction stroke.

Taking this into consideration, the gas bearing according to these embodiments allows a high-pressure compressed gas to be uniformly distributed between the cylinder and the piston by forming an oxide film layer having a plurality of fine through holes on the inner circumferential surface of the cylinder or the outer circumferential surface of the piston to make it easy to regulate the distribution of the fine through holes, or by forming gas flow paths in the cylinder and coupling a porous material member to the outer circumferential surface of the piston to uniformly distribute and supply a high-pressure compressed gas guided through the gas flow paths between the cylinder and the piston, or by forming gas flow paths in the cylinder and coupling a gas guide member having gas through holes to the outer circumferential surface of the piston to uniformly distribute and supply a high-pressure compressed gas guided through the gas flow paths between the cylinder and the piston, or by forming gas flow paths in the cylinder.

Figure 7:
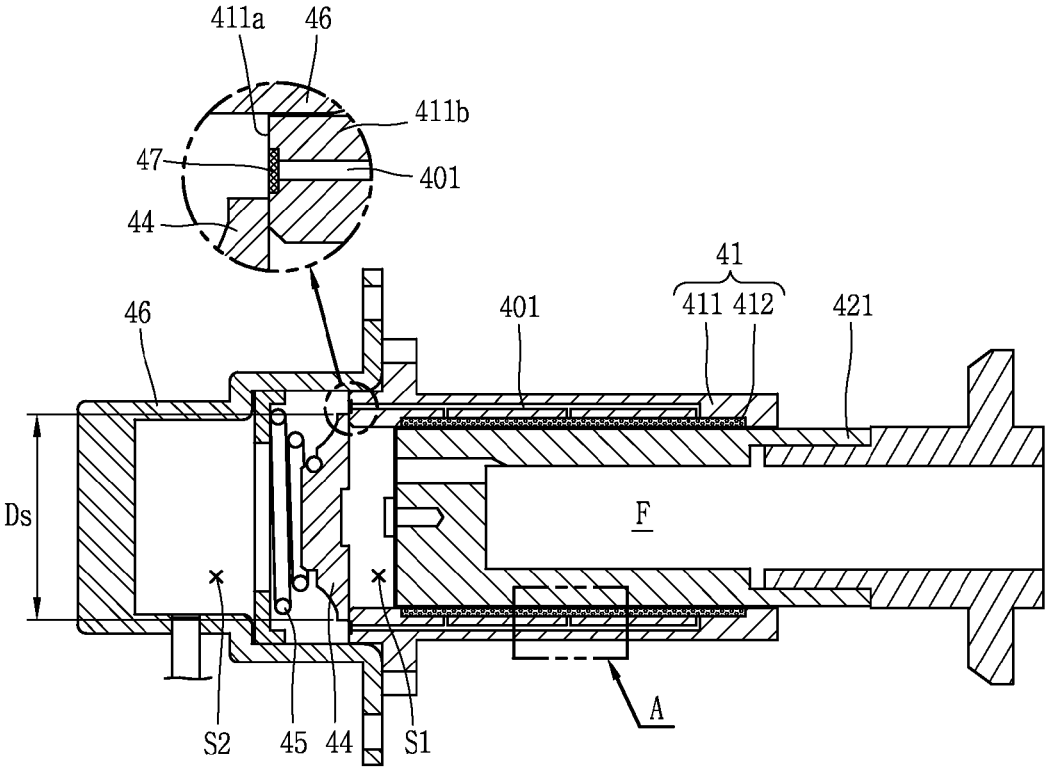
FIG. 7 is a cross-sectional view showing an embodiment of a gas bearing in the reciprocating compressor of FIG. 3.

As shown in FIG. 7, the oxide film layer 412 may be formed on an inner circumferential surface of a cylinder body 411 (or on an outer circumferential surface of a piston body) to have a plurality of fine through holes 412*a*. In this case, compressed gas guided to the fine through holes through gas flow paths 401 is uniformly supplied between the cylinder 41 and the piston 42 through the fine through holes 412*a* to form a gas bearing.

The oxide film layer 412 may be formed by anodizing or micro arc oxidation (MAO).

The gas flow paths 401 may be formed in the cylinder body 411 as shown in FIG. 7. The gas flow paths 401 may comprise at least one first flow path 401*a* formed in a reciprocating direction of the piston 42 on a front end surface 411*a* of the discharge side of the cylinder body 411 and a plurality of second flow paths 401*b* penetrating toward an inner circumferential surface of the cylinder body 411 on the midway of the first flow path 401*a*.

The front end surface 411*a* of the cylinder body 411 protrudes to a predetermined height to form a protruding portion 411*b*, and a discharge cover 46 is inserted and coupled to an outer circumferential surface of the protrusion 411*b*.

A starting end of the first flow path 401*a*, i.e., the inlet end of the first flow path 401*a* contacting a discharge space S2, is preferably formed at a greater distance than the radius Ds of the discharge valve 45 relative to the center of the discharge valve 45 so that it is positioned out of the attachment/detachment range of the discharge valve 45 which is selectively attached to and detached from the front end surface 411*a* of the cylinder body 411.

Although the diameter of the second flow paths 401*b* relative to the diameter of the first flow path 401*a* may fall within the range of 1/10 to 1, the diameter of the second flow paths 401*b* may be equal to or slightly greater than the diameter of the first flow path 401*a* because distal ends of the second flow paths 401*b* are in contact with the oxide film layer 412.

An annular filter 47 may be installed on the front end of the first gas flow path 401*a*, i.e., the front end surface 411*a* of the cylinder body 411 so as to prevent impurities from entering the gas flow paths 401.

Figure 8:
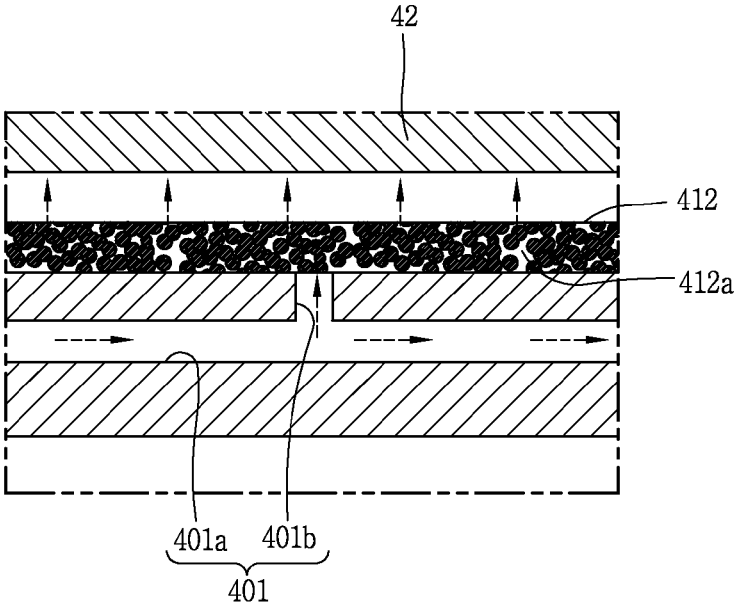
FIG. 8 is a cross-sectional view enlargedly showing portion "A" of FIG. 5.

Although at least one gas diffusion groove (not shown) may be further formed on the outer circumferential surface of the piston 42, a high-pressure compressed gas may be uniformly distributed over a bearing area between the cylinder 41 and the piston 42, as shown in FIG. 8, without forming a gas diffusion groove on the outer circumferential surface of the piston 42, because the oxide film layer 412 has a porous structure.

In the case that the a porous layer is formed of the oxide film layer, the porous layer is easily formed on the inner circumferential surface of the cylinder body, and the reliability of the compressor is improved because of high abrasion resistance and high rub resistance resulting from an increase in the strength of a bearing surface formed of an oxide film layer.

Figure 9:
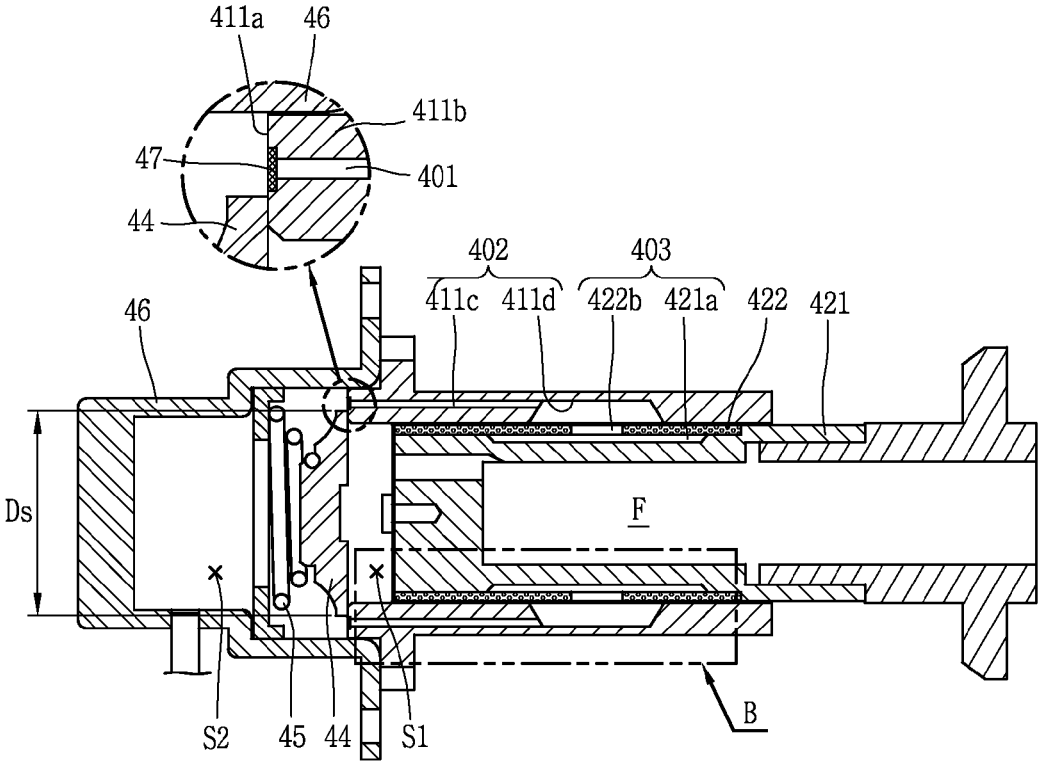
FIG. 9 is a cross-sectional view showing an embodiment of the gas bearing in the reciprocating compressor of FIG. 3.
Figure 10:
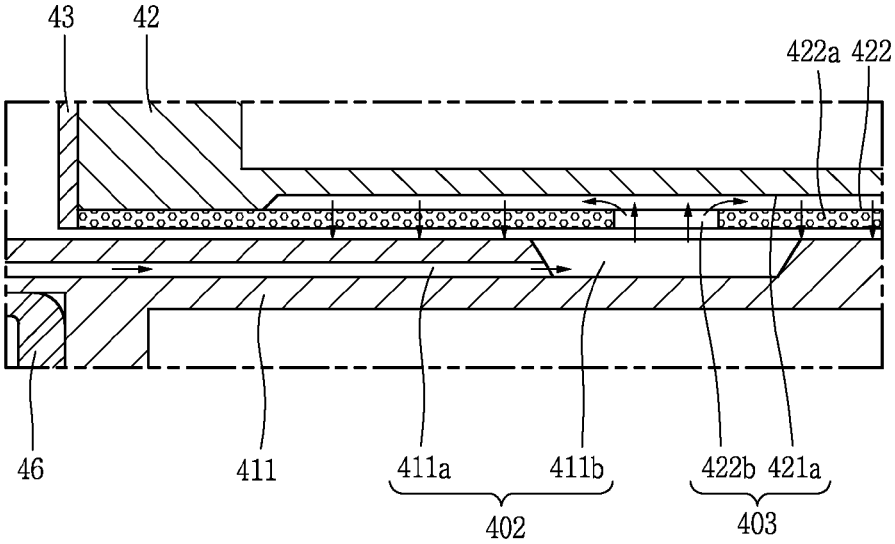
FIG. 10 is a cross-sectional view enlargedly showing portion "b" of FIG. 7.

As shown in FIGS. 9 and 10, a porous material member 422 may be inserted and coupled to an inner circumferential surface of the piston body 421 (or on an outer circumferential surface of the cylinder body). In this case, compressed gas guided to fine through holes 422*a* of the porous material member 422 through the gas flow paths 401 is uniformly supplied between the cylinder 41 and the piston 42 through the fine through holes 422*a* to form a gas bearing.

The gas flow paths 401 may comprise a cylinder side gas flow path 402 formed at the cylinder 41 and a piston side gas flow path 403 communicating with the cylinder side gas flow path 402 and formed at the piston 42.

The cylinder side gas flow path 402 may comprises at least one gas inlet opening 411*c* formed in a reciprocating direction of the piston 42 on a front end surface of the discharge side of the cylinder 41 and a gas pocket 411*d* formed on the inner circumferential surface of the cylinder 41, with its side wall surface communicating with the gas inlet opening 411*c*. The cross-sectional area of the gas pocket 411*d* may be much greater than the cross-sectional area of the gas inlet opening 411*c*.

The piston side gas flow path 403 may comprises a gas communication opening 422*b* formed at a center portion of the porous material member 422 and communicating with the gas pocket 411*d* of the cylinder 41 and a gas guide groove 421*a* formed on the outer circumferential surface of the piston body 421 and communicating with the gas communication opening 422*b*.

The gas guide groove 421*a* has an annular shape. Preferably, the gas guide groove 421*a* has a width in the reciprocating direction much larger than the width of the gas communication opening 422*b* in the reciprocating direction so that gas introduced into the gas guide groove 421*a* is uniformly distributed over the entire bearing surface, that is, the length of the gas guide groove 421*a* is as similar to the width of the porous material member 422 in the reciprocating direction as possible to increase the baring surface area as much as possible.

Although at least one gas diffusion groove (not shown) may be further formed on an outer circumferential surface of the porous material member 422, gas may be uniformly distributed over the bearing area between the cylinder 41 and the piston 42, without forming a gas diffusion groove on the outer circumferential surface of the porous material member 422, because gas is uniformly distributed due to the porous structure of the porous material member 422.

As in this embodiment, in the case that the porous material member 422 is inserted and coupled to the piston body 421, a part of compressed gas discharged to the discharge space S2 enters the gas pocket 411*d* through the gas inlet opening 411*c*, and this compressed gas enters the gas guide groove 421*a* through the gas communication opening 422*b* of the porous material member 422 and diffused in the gas guide groove 421*a*, thereby supplying the compressed gas between the cylinder 41 and the piston 42 through the fine through holes 422*a* of the porous material member 422.

Accordingly, a high-pressure compressed gas supplied between the cylinder 41 and the piston 42 is prevented from entering the compression space S1, thereby preventing a suction loss. Also, in the case that a gas inlet opening is formed in the piston 42, the gas inlet opening has to communicate with the compression space. Thus, it is necessary to install a check valve to prevent a refrigerant sucked into the compression space from leaking into the gas inlet opening when the piston performs a suction stroke, and this may increase manufacturing costs. Nevertheless, this embodiment allows a reduction in manufacturing costs because the gas inlet opening is formed at the cylinder side and makes the process easier.

Figure 11:
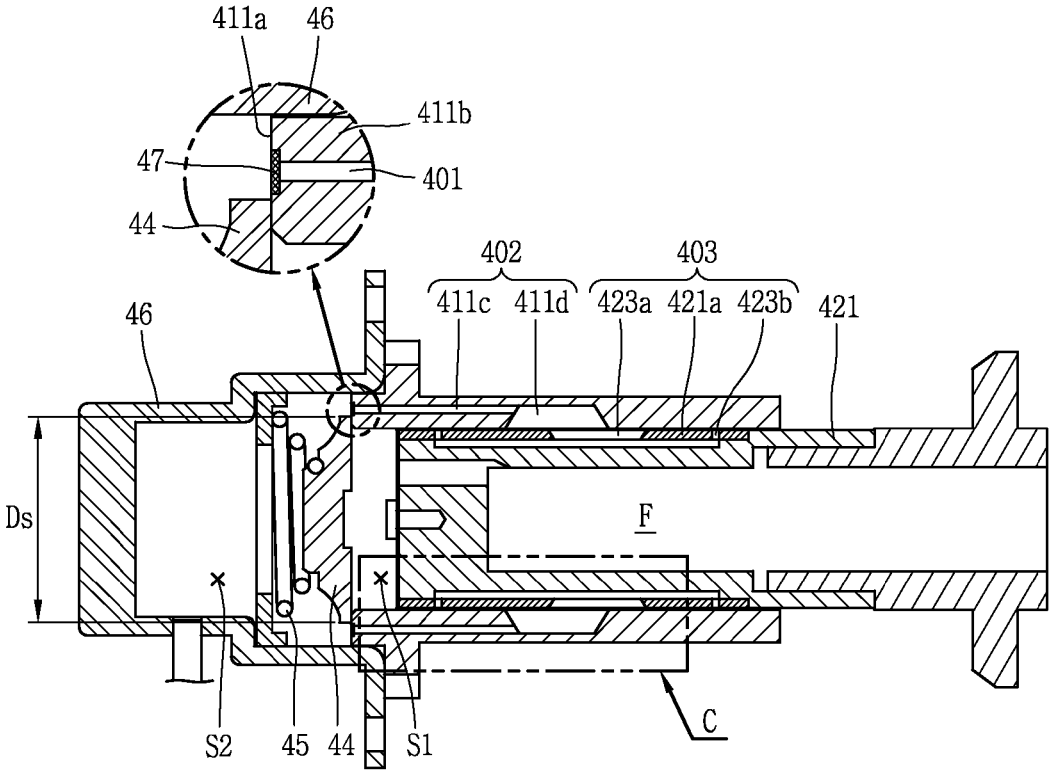
FIG. 11 is a cross-sectional view showing yet another embodiment of the gas bearing in the reciprocating compressor of FIG. 3.
Figure 12:
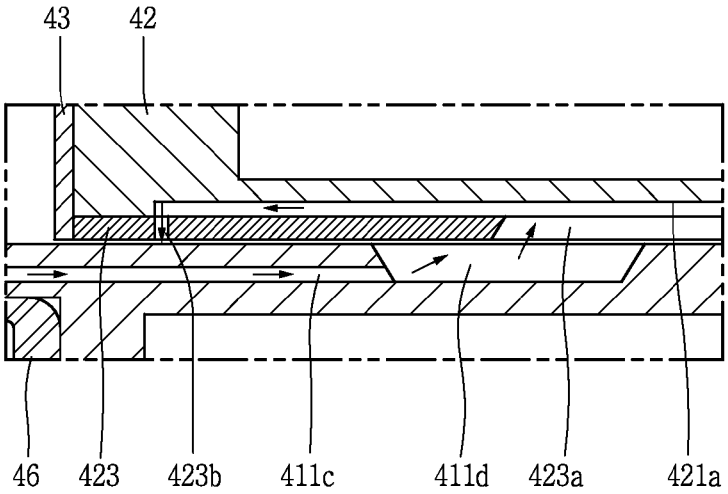
FIG. 12 is a cross-sectional view enlargedly showing portion "c" of FIG. 9.

As shown in FIGS. 11 and 12, in the case that gas flow paths are formed in the piston 42, the gas flow paths are not exposed to the suction space even when the piston performs a suction stroke, thereby preventing a suction loss.

For example, at least one gas inlet opening 411*c* constituting the cylinder side gas flow path 402 is formed in a reciprocating direction of the piston body 421 on the front end surface 411*a* of the discharge side of the cylinder body 411, and a gas pocket 411*d*, whose side wall surface communicates with the gas inlet opening 411*c* and constitutes the gas flow path 402 along with the gas inlet opening 411*c*, is formed on the inner circumferential surface of the cylinder body 411.

A cylindrical gas guide member 423 is inserted and coupled to the outer circumferential surface of the piston body 421. A gas communication opening 423*a* communicating with the gas pocket 411*d* and constituting the piston side gas flow path 403 is formed at a center portion of the gas guide member 423, a gas guide groove 421 communicating with the gas communication opening 423*a* and constituting the piston side gas flow path 403 is formed on the outer circumferential surface of the piston body 421, and a plurality of bearing holes 423*b* are formed on both end portions of the gas guide member 423 so that gas guided through the gas guide groove 421*a* is supplied between the cylinder 41 and the piston 42.

Preferably, the bearing holes 423*b* have a significantly smaller size than the gas communication opening 423*a* to prevent excessive exposure of compressed gas.

Preferably, one or more gas diffusion groove (not shown) may be further formed on an outer circumferential surface of the gas guide member 423 because the compressed refrigerant gas is uniformly distributed over the bearing area between the cylinder 41 and the piston 42.

Preferably, the gas diffusion groove is formed to communicate with the gas communication opening 423*a* or the bearing holes 423*b* so that the compressed gas entering or introduced into the gas guide groove 421*a* quickly enters the gas diffusion groove.

In the above-described embodiment, because the gas flow paths are formed in the piston 42, the gas flow paths are not exposed to the compression space S1 during a suction stroke of the piston thereby preventing a degradation in the performance of the compressor caused by a suction loss.

Moreover, the gas guide member 423 has a simple cylindrical shape, and hence the manufacturing costs can be reduced, compared to the porous material member.

Figure 13:
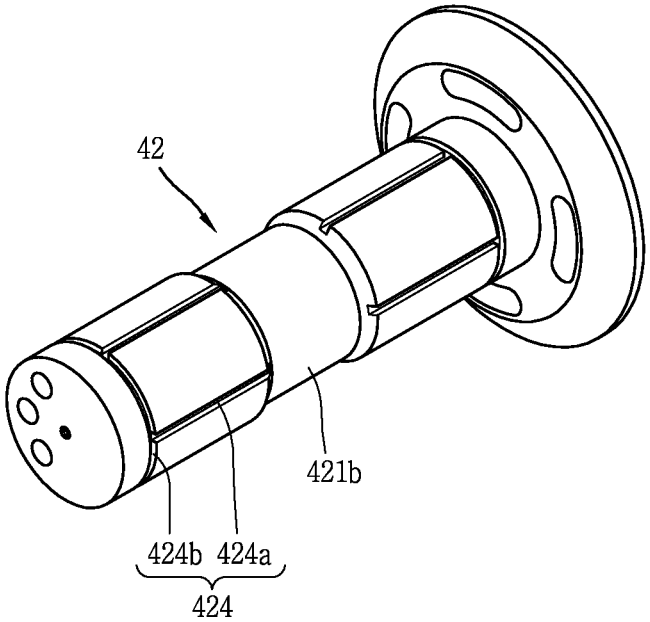
FIG. 13 is a perspective view showing an embodiment of a piston having a gas diffusion groove in the reciprocating compressor of FIG. 3.
Figure 14:
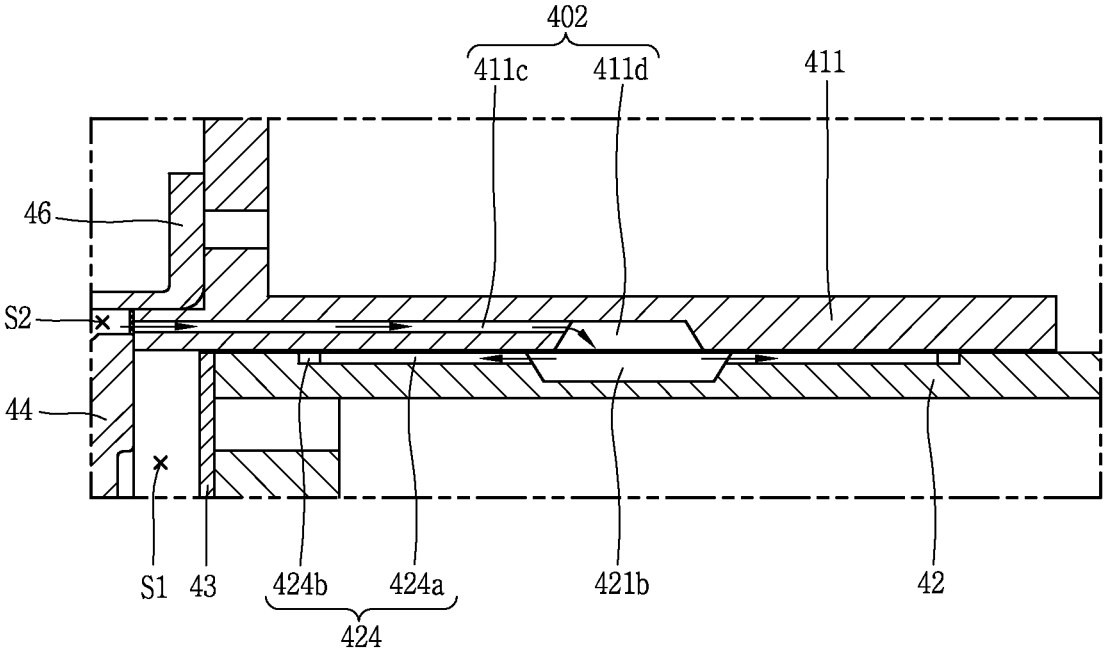
FIG. 14 is a cross-sectional view showing a process in which gas is diffused between the piston having the gas diffusion groove of FIG. 13 and a cylinder.

As shown in FIGS. 13 and 14, a gas diffusion groove 424 may be formed on the outer circumferential surface of the piston without providing a porous member or gas guide member in the piston 42.

The gas diffusion groove 424 may comprise a linear groove 424*a* communicating with the gas pocket 411*d* of the cylinder side gas flow path 402 and an annular groove 424*b* communicating with the linear groove 424*a* and having an annular shape.

A piston side gas pocket 421*b* may be formed on the outer circumferential surface of the piston to communicate with the gas pocket 411*d* of the gas flow path 402, and the linear groove 424*a* of the gas diffusion groove 424 may be formed to communicate with the piston side gas pocket 421*b*.

In the above-described embodiment, it is preferable that the linear groove 424*a* of the gas diffusion groove 424 is formed to communicate with the piston side gas pocket 421*b* because a refrigerant entering the piston side gas pocket 421*b* is diffused fast over the bearing surface between the cylinder 41 and the piston 42 while quickly moving to the gas diffusion groove 424.

In the above-described reciprocating compressor with the gas bearing, the resonant springs may be plate springs, which have a small lateral displacement, because the piston 42 has to maintain forward movement.

However, the plate springs have a small lateral displacement but a large longitudinal displacement. Therefore, if the compressor is installed stood in the motion direction of the piston, a compression stroke may not be properly performed because the piston hangs vertically downward. Moreover, when the plate springs are used, the plate springs and the piston have to be connected by a connecting bar made of soft material or by at least one link (preferably two links) on the midway of the connecting bar, in order to maintain the forward movement of the piston, which may increase material costs and the number of assembly processes.

The above-described reciprocating compressor with the gas bearing according to this embodiment is devised to reduce material costs and the number of assembly processes by varying the configuration of the compressor by using not plate springs but coil springs as the resonant springs, and avoiding the use of a connecting bar or link.

Figure 15:
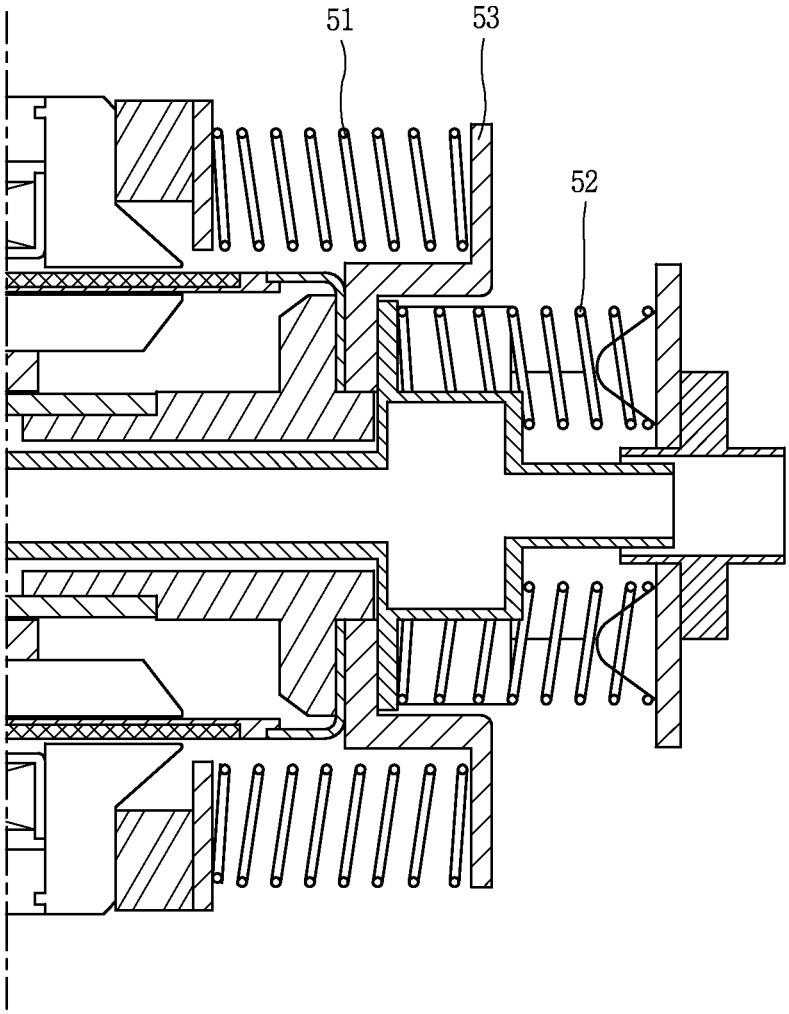
FIG. 15 is a partial cross-sectional view for explaining resonant springs in the reciprocating compressor of FIG. 3.

As shown in FIG. 15, the resonant springs may comprise a first resonant spring and a second resonant spring 52 which are respectively provided on both front and back sides of a spring supporter 53 coupled to the mover 32 and the piston 42.

The first resonant spring 51 and the second resonant spring 52 each are provided in plural and arranged in a circumferential direction. However, either the first resonant spring 51 or the second resonant spring 52 may be provided in plural, and the other resonant spring may be provided in singular.

If the first resonant spring 51 and the second resonant spring 52 are compressed coil springs as described above, a side force may be produced when the resonant springs 51 and 52 are expanded. Accordingly, the resonant springs 51 and 52 may be arranged so as to offset a side force or torsion moment of the resonant springs 51 and 52.

Figure 16:
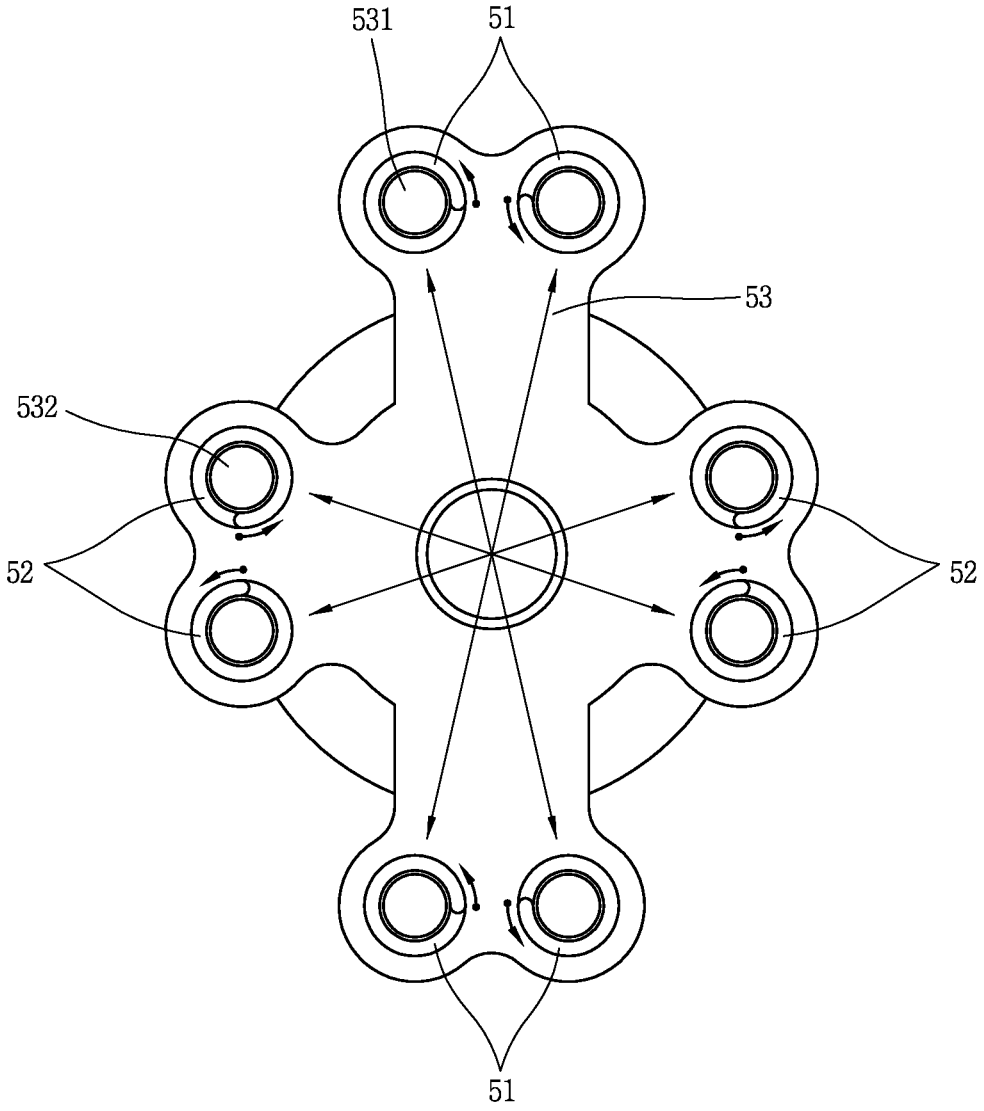
FIG. 16 is a top plan view for explaining the arrangement of the resonant springs of FIG. 15.

For example, as shown in FIG. 16, in the case that the first resonant spring 51 and the second resonant spring 52 are arranged alternately by twos in a circumferential direction, distal ends of the first and second resonant springs 51 and 52 are wound at the same position in opposite directions (counterclock wise) relative to the center of the piston 42, and the resonant springs on the same side positioned in their respective diagonal directions are arranged to symmetrically engage each other so that a side force and a torsion moment are produced in opposite directions.

Also, the first resonant spring 51 and the second resonant spring 52 may be arranged to symmetrically engage the distal ends of the resonant springs with each other so that a side force and a torsion moment are produced in opposite directions along the circumferential direction.

Although not shown, if the number of first resonant springs 51 is odd, they are arranged so that lines orthogonal to the front end surfaces of the springs meet at one point to thus offset a side force and a torsion moment.

Preferably, spring fixing protrusions 531 and 532 are respectively formed on a frame or spring supporter 53 to which the ends of the first and second resonant springs 51 and 52 are fixed, in order for the resonant springs 51 and 52 to be forcibly fit and fixed to the spring fixing protrusions 53, because the engaging resonant springs are prevented from turning.

The number of first resonant springs 51 may be equal to or different from the number of second resonant springs 52 as long as the first resonant spring 51 and the second resonant spring 52 have the same elasticity.

The above-described reciprocating compressor with the gas bearing according to this embodiment has the following operational effects.

That is, when power is applied to the coil 35, a magnetic flux is formed around the coil 35. The magnetic flux may then create a closed loop along the first magnetic path 311, second magnetic path 312, and magnetic path connecting portion 313 of the stator 31. In cooperation with an interaction between the magnetic flux formed between the first magnetic path 311 and the second magnetic path 312 and a magnetic flux generated by the magnet 325, the magnet 325 linearly moves together with the magnet holder 321 in the motion direction. When a flow direction of current applied to the coil 35 alternately changes, the direction of the magnetic flux of the coil 35 may also change, to make the magnet 325 linearly reciprocate.

Then, the piston 42 coupled to the magnet holder 321, being inserted in the compression space S1 of the cylinder 41, reciprocates together with the magnetic holder 321. By the reciprocation of the piston 42, the first resonant spring 51 and the second resonant spring 52 respectively provided on both sides of the piston 42 in the motion direction are alternately expanded to induce a resonating motion of the piston 42.

Hereupon, the resonant springs 51 and 52 may produce a side force and a torsion moment when expanded because of the characteristics of compression coil springs, and therefore the forward movement of the piston 42 may be distorted. In this embodiment, however, the plurality of first resonant springs 51 and second resonant springs 52 are arranged to be wound in opposite directions, and therefore the side force and torsion moment produced from the resonant springs 51 and 52 are offset by the diagonally corresponding resonant springs. Accordingly, the forward movement of the piston 42 can be maintained, and abrasion of surfaces contacting the resonant springs 51 and 52 can be prevented.

Moreover, the compressor can be installed in a standing type, as well as in a lateral type because compression coil springs, which have a small longitudinal placement, are used as the resonant springs 51 and 52. The manufacturing costs and the number of assembly processes can be reduced because no connecting bar or link is required.

Although the foregoing embodiments have been described with respect to the case where the cylinder is inserted into the stator of the reciprocating motor, the resonant springs may be used in the same manner as above even when the reciprocating motor is mechanically coupled to a compression unit comprising the cylinder with a predetermined interval therefrom. A detailed description of which will be omitted.

Further, in the foregoing embodiments, the piston is configured to reciprocate and the resonant springs are respectively provided on both sides of the piston in the motion direction. In some cases, however, the cylinder may be configured to reciprocate and the resonant springs may be provided on both sides of the cylinder. In this case, too, the resonant springs may be formed as a plurality of compression coil springs, as in the foregoing embodiments, and the plurality of compression coil springs may be arranged in the same manner as the foregoing embodiments. A detailed description of which will be omitted.

What is claimed is:

1. A reciprocating compressor with a gas bearing, the reciprocating compressor comprising:

a cylinder having a compression space;

a piston inserted into the compression space, that reciprocates relative to the cylinder;

a discharge valve configured to be attachable to and detachable from a front end surface of the cylinder, to selectively open and close the compression space of the cylinder;

a discharge cover having a discharge space that selectively communicates with the compression space by the discharge valve, and coupled to a front end of the cylinder, a gas bearing that lubricates a bearing surface of the cylinder and the piston by gas; and a plurality of resonant springs that supports both sides of the piston in a motion direction, wherein the plurality of resonant springs includes at least one first resonant spring and at least one second resonant spring in the form of compression coil springs, and provided, respectively, on the both sides of the piston, wherein a plurality of at least one of the first resonant spring or the second resonant spring is provided, wherein the plurality of resonant springs is arranged such that lines orthogonal to front end surfaces of at least two of the plurality of resonant springs in a winding direction meet at one point, and wherein the gas bearing includes:

an inlet formed in the cylinder at a distance which is greater than a radius of the discharge valve relative to a center of the discharge valve;

at least one first gas flow path formed in the cylinder in communication with the at least one gas inlet opening, wherein a central longitudinal axis of the at least one first gas flow path extends substantially parallel to a central longitudinal axis of the cylinder;

at least one second gas flow path formed in the cylinder, wherein a central longitudinal axis of the at least one second gas flow path extends substantially perpendicular to the central longitudinal axis of the at least one first gas flow, wherein the gas is provided to the bearing surface through the at least one second gas flow path;

a gas communication opening formed at a center portion of a gas guide provided on an outer circumferential surface of the piston;

a gas guide groove formed on the outer circumferential surface of the piston, wherein the gas guide groove communicates with the gas communication opening, and wherein the gas guide groove has an annular shape and has a larger length in the reciprocating direction of the piston than the gas communication opening so that gas introduced into the gas guide groove is uniformly distributed over the entire bearing surface between the cylinder and the piston; and a plurality of holes formed at both sides of the gas communication opening in the reciprocating direction of the piston, respectively.

2. The reciprocating compressor of claim 1, wherein the plurality of the one of the first resonant spring or the second resonant spring is arranged to engage each other such that distal ends of the plurality of first or second resonant springs are wound at a same distance in opposite directions relative to a center of the piston.

3. The reciprocating compressor of claim 1, wherein the plurality of the one of the first resonant spring or the second resonant spring is arranged to engage each other such that distal ends of the plurality of first or second resonant springs are wound at a same distance in opposite directions along a circumferential direction relative to a center of the piston.

4. The reciprocating compressor of claim 1, wherein a number of the first resonant spring is equal to a number of the second resonant spring.

5. The reciprocating compressor of claim 1, wherein the at least one second gas flow path includes an annular gas pocket formed on an inner circumferential surface of the cylinder that communicates with the at least one first gas flow path.

6. The reciprocating compressor of claim 1, wherein the gas guide has a cylinder shape and includes the plurality of holes at both sides of the gas communication opening, wherein each of the plurality of holes has a significantly smaller surface area than the gas communication opening.

7. The reciprocating compressor of claim 1, wherein the gas guide is formed as a porous material.

* * * * *